United States Patent [19]

Vickery

[11] Patent Number: 5,061,463

[45] Date of Patent: Oct. 29, 1991

[54] COINCINERATOR APPARATUS AND METHOD FOR PROCESSING WASTE GASES

[75] Inventor: Earl Vickery, San Jose, Calif.

[73] Assignee: Hoechst Celanese Corporation, Somerville, N.J.

[21] Appl. No.: 397,990

[22] Filed: Aug. 24, 1989

[51] Int. Cl.[5] ..... B01D 53/34; F23C 7/00; F23G 7/06

[52] U.S. Cl. ..... 423/210; 110/214; 422/111; 422/183; 423/245.3; 431/5

[58] Field of Search ..... 422/111, 183; 431/5, 431/176, 188, 2; 423/215.5, 245.3, 210; 55/83; 110/214

[56] References Cited

U.S. PATENT DOCUMENTS

| | | | |
|---|---|---|---|
| 1,834,126 | 12/1931 | Hyatt | 422/183 |
| 1,839,880 | 1/1932 | Hyatt | 422/183 |
| 2,537,091 | 1/1951 | Rodman et al. | 431/5 |
| 3,838,974 | 10/1974 | Hemsath et al. | 423/210 |
| 3,893,810 | 7/1975 | Lientz | 422/111 |
| 4,531,462 | 7/1985 | Payne | 110/214 |

*Primary Examiner*—Jeffrey E. Russel

*Attorney, Agent, or Firm*—Perman & Green

[57] ABSTRACT

A method and apparatus for the more complete incineration of dangerous waste gases to produce by-products which are safer for eventual release into the atmosphere. The invention involves mixing the waste gases with a flammable co-incineration fuel at an upstream location which is devoid of a combustion-supporting atmosphere, moving the mixture downstream to an ignitor fuel flame, and introducing a source of oxygen immediately downstream of the flame to support the combustion of the flame. The flame ignites the co-incineration fuel which, together with the flame, co-incinerates the waste gases in an area between the upstream area at which the waste and fuel gases are mixed and the downstream area at which the source of oxygen is admitted. The invention also preferably includes centering the co-incineration reaction for "cold wall" operation, mixing the by-products with air for cooling purposes.

15 Claims, 1 Drawing Sheet

COINCINERATOR APPARATUS AND METHOD FOR PROCESSING WASTE GASES

BACKGROUND OF THE INVENTION

The present invention relates to an improved apparatus and method for providing a more complete incineration of waste gases, including any oily and/or flammable particles thereof, such as from reaction processes, prior to the entry of the waste gas by-products into a duct system leading to scrubbers and/or direct discharge into the atmosphere.

Reference is made to my U.S. Pat. No. 4,661,056, issued Apr. 28, 1987, for its disclosure of an apparatus which is designed for the controlled incineration of waste gases and which functions by introducing the combustible waste gases under low pressure to an air conduit, through a controlled combustion conduit in which the waste gases are mixed with swirling air, ignited and then drawn into the air conduit and conveyed through a scrubber at the exit end of the air conduit for release as non-combustible reaction products.

Controlled combustion devices and purging devices for combustible waste gases must be capable of operation under low pressures since such waste gases commonly are by-products of reactions which take place at or slightly above atmospheric pressure and which require the laminar flow of combustible reaction gases or by-product gases through the reactor. Any attempt to increase the pressure of the waste gases as they enter the controlled combustion conduit can lead to back-pressure problems within the reactor. However, the exposure of the combustible waste gases at relatively low pressures, i.e., atmospheric or only slightly higher, and a malfunction which allows air or some other oxidizing material to mix with the waste gas to the ignition means in a combustion chamber, in the case of controlled combustion devices, or to an unintentional spark or other accidental ignition source within the transport conduit or scrubber, in the case of non-incineration purging systems, creates the danger that the controlled fire within the combustion conduit or accidental fire within the conduit might flash back upstream through the reactor exhaust pipe into the reactor or other processing equipment creating disruptive and possibly dangerous conditions. The flame propagation rate of hydrogen and air, for example, is about 8.25 feet per second, which permits the flame to travel upstream against the low pressure flow of a waste gas containing hydrogen.

The apparatus of my aforementioned Patent is an incineration apparatus which assists the mixing of air with the waste gas by creating a swirling action and vacuum within the air conduit, at the downstream end of the waste gas conduit, beyond a combustion chamber.

While it is known to use a variety of commercially-available flame-arresting devices in waste gas processing systems to prevent or reduce the dangers discussed above, such devices are only effective against the flashing of the flame back upstream from the ignition chamber. However, if the incineration of the waste gases is incomplete such as those found in the exhaust from elastomer coating or curing ovens or those emitted by roughing pumps connected to the equipment for the plasma deposition of silicon nitride films, i.e., silane, ammonia, nitrogen, argon and oil vapor, such gases and/or oil vapors or other combustible materials pose a downstream danger of uncontrolled fire which can be swept through the duct system by the downstream movement of air. For example, flammable oily components of the waste gases can deposit on the inner walls of the duct as a layer which builds up over a period of time and entraps other combustible materials. If a condition arises which ignites the flammable oils and/or other combustible materials an uncontrolled fire can result, which fire can propagate and be swept through the duct system. An example of this condition can be illustrated with an analysis of deposits found in the ductwork of one such system. The solids were composed of 99.48% volatile components which were flammable and unpredictably pyrophoric.

It is the principal objective of the present invention to provide a new and improved apparatus and method for the complete incineration of waste gases, including oil vapors and other combustible materials present therein, so as to prevent the possibility of ignition thereof, downstream of the incinerator, resulting in uncontrolled fire within the duct system leading to scrubbers and/or the safe discharge to the atmosphere.

SUMMARY OF THE INVENTION

The present method and apparatus relate to the co-incineration of dangerous waste gases, including any oily and/or flammable particles present therein or formed as by-products of the combustion thereof, in order to render the burned waste gases safer for release to the atmosphere. Coincineration is accomplished by means of two fuel gases, one of which is an incineration gas which is pre-mixed with the waste gases at an upstream location which does not support combustion and the other of which is an ignition gas which is supplied in ignited condition at a downstream combustion chamber, immediately downstream of which a combustion-supporting gas, such as air, is admitted to support the combustion of the ignition fuel gas.

The burning ignition fuel gas incinerates the waste gases and also ignites the incineration gas which is pre-mixed with the waste gases.

The incineration gas renders the mixture more completely flammable and functions to co-incinerate the waste gases and their inclusions and their combustion co-products, so as to produce a more complete incineration thereof and safer by-products.

The present apparatus isolates the inlet for the combustion-supporting gas downstream from the inlets for the flammable waste gases and the co-incineration fuel gas, and positions the combustion chamber immediately upstream of the inlet for the combustion-supporting gas to support the co-incineration within the combustion chamber and to prevent upstream migration of sufficient combustion-supporting gas to produce a combustion-supporting atmosphere at the upstream waste gas and incineration fuel inlet areas.

The present apparatus also provides "cold wall" incineration conditions in the area of the combustion chamber by centering the incineration reaction within the combustion chamber, away from the wall thereof, and by introducing the combustion-supporting gas, such as air, as a continuous flow which is caused to pass over the outer wall of the combustion chamber with resultant cooling thereof. Cool wall conditions help to prevent the deposit or formation of waste gas products or by-products on the inner wall of the combustion chamber and/or on the downstream conduit walls, thus reducing the possibility of plugging of the conduit.

The novel apparatus of this invention also includes means for sensing and regulating the temperature of the exhaust gases to be released to the atmosphere.

THE DRAWINGS

FIG. 1 is an elevational cross-sectional view of a co-axial co-incinerator according to a preferred embodiment of the present invention;

FIG. 2 is cross-section taken along the line 2—2 of FIG. 1, the various elements 11, 12, 14 and 19 to 22 thereof being as identified in the description of FIG. 1, and FIG. 3 is a cross-section taken along the line 3—3 of FIG. 1, the elements 12 and 26 thereof being as identified in the description of FIG. 1.

DETAILED DESCRIPTION OF THE INVENTION

The novel apparatus of the present invention, according to a preferred embodiment thereof, is a co-axial, dual region co-incinerator comprising an upstream inner duct or conduit section which terminates at a downstream combustion chamber, and a larger downstream outer duct or conduit section which is coaxial with the downstream end of the inner conduit section, i.e., the combustion chamber thereof, and has air inlet means in the annular gap or space between itself and the inner duct or conduit opening downstream of the outlet end of the inner duct or conduit. The inner duct or conduit includes upstream waste gas inlet means for receiving a continuous supply of waste gases under slight pressure, upstream co-incineration fuel inlet means for introducing a supply of flammable fuel gases such as hydrogen, methane (natural gas), propane, etc., and a fuel-burning ignition means located at or adjacent the downstream exit end of the inner duct or conduit. Thus, downstream end of the inner duct or conduit comprises a combustion chamber or incinerator for the waste gases and the co-incineration fuels but the gas mixture supplied thereby, per se, does not support combustion since it is substantially devoid of oxygen. The other duct or conduit admits the oxygen necessary to support the combustion of the waste gases and co-incineration fuels to the outlet end of the inner conduit, at a location downstream thereof, so that the necessary oxygen is aspirated upstream into the combustion chamber to provide a controlled co-incineration of the waste gases and fuels within the combustion chamber of the inner conduit, immediately adjacent the ignition means present at the outlet end thereof. Most preferably the ignition means is a peripheral flame means for providing a substantially continuous radial flame extending inwardly from the adjacent interior wall of the inner conduit towards the center thereof to produce combustion of the waste gases and fuels at that location, thereby reducing the chances of the combustible mixture burning at or near the interior wall of the inner conduit and helping to maintain "cold wall" conditions which reduce solid product deposits.

The design of the preferred co-axial conduit co-incinerator insulates the waste gas and fuel inlets upstream from the oxygen or air inlet a distance sufficient to prevent the presence of a combustible gas mixture in the areas of the waste gas and fuel inlets, provides an oxygen-rich atmosphere in the area of the ignition means at the outlet end of the inner conduit, and provides an air purging, dilution and cooling atmosphere for conveying the incinerated gases for safe disposal.

Figure 1:
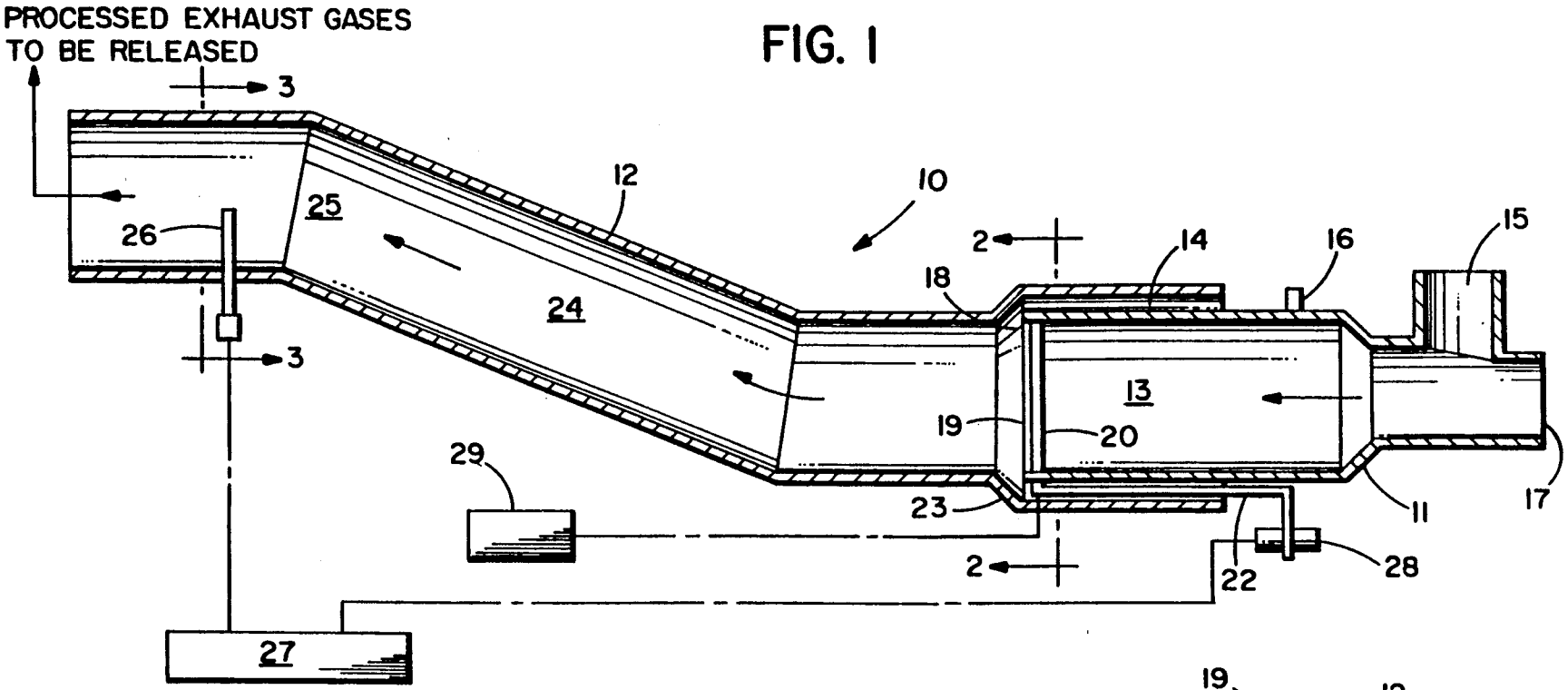

Referring to the drawings, FIG. 1 illustrates a co-axial co-incinerator 10 for the safe and complete incineration of waste gases delivered thereto from a source such as a reactor, oven or other system producing volatilized waste materials which require incineration to a safer form.

Co-incinerator 10 comprises an upstream inner cylindrical conduit section 11 and a downstream outer cylindrical conduit section 12 which is co-axial with and overlaps the inner section 11 in the area surrounding the combustion chamber 13 of the latter. In said area, for example, the inner diameter of conduit section 12 may be about eight inches and the outer diameter of the inner conduit section may be about six inches, leaving an annular one inch space passage 14 therebetween, the conduit sections being formed of mild steel or stainless steel.

The inner conduit section 11 has a waste gas inlet neck 15 adapted to be connected by a suitable conduit to a source container of waste gases, such as a reactor, oven, etc. Section 11 also has a co-incineration fuel inlet neck 16 adapted to be connected by a suitable conduit to a source of pressurized co-incineration fuel, such as natural gas. An end view port 17 may be present to enable the downstream incineration reaction to be viewed.

Figure 2:
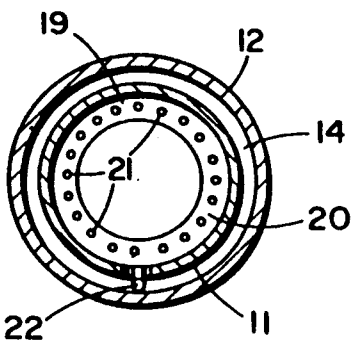

The inner conduit section 11 is closed at the upstream end, except for the inlet necks 15 and 16 which are open to the said gases, and has a wide opening 18 at the downstream end at or within which is mounted a fuel-burning ignition means 19. The preferred ignition means 19, as illustrated in FIGS. 1 and 2, comprises a ¼ inch stainless steel tubular ring portion 20 provided with a plurality of jet openings 21, about 0.003 inch in diameter, drilled every ½ inch at an angle of 45 degrees from perpendicular, so as to direct streams of ignitor fuel radially inwardly to the combustion chamber. When ignited the ignition means provides a ring of flame just inwardly of the mouth 18 of the inner conduit, which controls the burning of the waste gases and co-incineration fuel at a location centered within the combustion chamber and spaced inwardly from the inner wall thereof to maintain the wall as cool as possible and reduce the deposit of solid ignition products on said wall.

The ignition means 19 also comprises an ignition fuel supply tube 22 which communicates with the tubular ring portion 20 to provide a continuous adjustable supply of pressurized ignitor fuel, such as propane, from a source to the ignition ring 20 for metered release through the jet openings 21 and ignition to provide a desired ring of ignition flame adjacent the downstream opening 18 or mouth of the inner conduit 11 and its combustion chamber 13.

Figure 3:
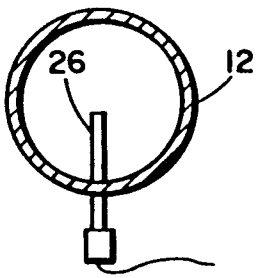

As shown in FIG. 1, the preferred configuration of the outer conduit 12 includes a narrowing or restriction 23 immediately downstream of the mouth 18 of the inner conduit 11 from a diameter of about eight inches down to a diameter of about six inches, and a mixing region 24 into which the downstream flow of the combusted gases and air is diverted and disrupted in order to produce a measure of intermixing and homogenization of the combusted gases and air. The mixture then flows through an exhaust region 25 of the conduit 12 containing a temperature-sensing thermocouple probe 26 which is electrically connected, through a temperature control means 27, to an automatically-adjustable valve means 28 in the ignitor fuel line 22, as shown by FIGS. 1 and 3.

An essential feature of a preferred embodiment of the present method and apparatus is the co-axial overlapping of the upstream end of the outer conduit 12 and the downstream end of the inner conduit which comprises the combustion chamber 13 thereof. This structure provides an annular air intake passage 14 which completely surrounds the combustion chamber and cools the annular wall thereof as air is drawn into the upstream open end of the annular passage 14 by the vacuum created by the flow of gases through the conduit sections 11 and 12.

The air supply drawn in through the passage 14 provides an oxygen-rich mixture in the area of the annular ignition means 19 to support ignition of the ignitor fuel released through the jet openings 21 of the ring portion 20. Ignition is initiated by an electronic spark ignitor 29 associated with the ring portion 20, and a ring of flame is directed at an angle of 45° into the combustion chamber 13 to center the co-incineration reaction.

The novel structure of the present apparatus causes the incineration-supporting air to be introduced downstream of the inlets 15 and 16 for the waste gases and co-incineration fuel, respectively, and to be spaced therefrom by the combustion chamber 13 in which the oxygen of the air is consumed before it can migrate back upstream sufficiently to produce a combustion-supporting mixture in the areas of the inner conduit 11 into which the inlets 15 and 16 open. This is further prevented by the downstream flow of the waste gases and co-incineration fuel which restricts the upstream oxygen-rich atmosphere to the area of the combustion chamber 13 adjacent the ignition means 19.

The waste gases are co-incinerated in the combustion chamber 13 by both the flames of the ignitor fuel released by the ignition means and by the co-incineration fuel which is also burned by the flames of the ignitor means. This provides a more complete incineration of both the flammable and non-flammable ingredients of the waste gases, thereby reducing or eliminating the deposit of oily or solid waste materials on the walls of the incinerator. This result is further enhanced by the design of the incinerator which maintains "cold wall" conditions by centering the co-incineration reaction within the combustion chamber 13, away from the annular wall thereof, and by providing an air-cooling of the outer wall of the combustion chamber 13 as the intake air through annular air passage 14 passes thereover.

Another important advantage of the preferred apparatus of the present invention is the ability to control the temperature of the gases released thereby to a reduced temperature range which is within acceptable limits. Cooling of the co-incinerated waste gases is produced by the air drawn in through the annular opening 14, only a portion of which enters the combustion chamber 13 to support the combustion reactions. Most of the air mixes with the hot co-incinerated gases and flows downstream therewith to provide cooling thereof. This cooling effect is enhanced by diverting the mixture away from a straight direction to cause turbulence and more uniform intermixing of the air and the co-incinerated waste gas by-products. This result is accomplished by the detour caused by the mixing section 24 of the downstream duct of the outer conduit 12.

When the temperature of the exhaust gas mixture, as detected by the probe 26, exceeds a predetermined maximum temperature, the control means 27 automatically actuates the valve means 28 on conduit 22 to an off position and can also signal the equipment connected to the incinerator to stop sending flammable gas.

While the present drawings illustrate a preferred embodiment of the present invention, it should be understood that variations of the apparatus may be found to be equally suitable for different uses to which the present apparatus may be put. Such different uses may relate to the co-incineration of different types of gaseous or volatilized waste products released from reactors, ovens, evaporators, furnaces or other chambers from which toxic or flammable or otherwise dangerous gases are released.

I claim:

1. A method of co-incinerating dangerous waste gases to form by-products which are safer for release into the atmosphere, which comprises confining said waste gases within a conduit, mixing said waste gases with a flammable co-incineration fuel gas at an upstream inlet location within said conduit at which there is insufficient oxygen to support combustion, moving the mixture downstream to a combustion chamber containing a source of flammable ignitor fuel gas adapted to emit a flame when ignited in a combustion-supporting atmosphere, introducing a continuous supply of an oxygen-containing gas immediately downstream of said combustion chamber to provide a combustion-supporting atmosphere within said combustion chamber, and igniting said ignitor fuel gas to a flame to ignite the co-incineration fuel gas and co-incinerate the waste gases within said combustion chamber at a location downstream of said upstream inlet location and upstream of the location at which the oxygen-containing gas is introduced to said conduit.

2. The method of claim 1 which comprises introducing said ignitor fuel gas at a plurality of locations to provide a ring of flame extending inwardly from the inner periphery of said conduit towards the center thereof.

3. The method of claim 1 which comprises introducing said oxygen-containing gas through a downstream opening surrounding said conduit.

4. The method of claim 1 which comprises mixing the co-incinerated waste gas by-products with air at a location downstream of said combustion chamber to form a cooled exhaust mixture, and moving said mixture to an exhaust area of the conduit.

5. The method of claim 4 which comprises sensing the temperature of the mixture in the exhaust area of the conduit and adjusting the volume of the ignitor fuel gas to shut off the flame and the waste gas producing equipment and control the temperature of the exhaust within a pre-set range.

6. The method of claim 1 which comprises providing an upstream conduit section terminating at said combustion chamber, and a downstream conduit section, the upstream end of which is co-axial with and spaced outwardly from said combustion chamber to provide an annular passage opening immediately downstream of said combustion chamber, and providing a continuous source of air to said passage to maintain a combustion-supporting atmosphere in said combustion chamber and to mix with and cool the co-incineration by-products and form an exhaust mixture.

7. The method of claim 6 which comprises creating a turbulence in said exhaust mixture to produce maximum intermixing and cooling thereof.

8. A co-incineration apparatus for co-incinerating dangerous waste gases to form by-products which are safer for release into the atmosphere, comprising an elongate conduit having an upstream inlet section, an intermediate combustion chamber section and a downstream exhaust section, said upstream inlet section having an upstream inlet area comprising an inlet means for receiving a supply of dangerous waste gases to be incinerated and an inlet means for receiving a supply of a flammable co-incineration fuel gas for admixture with said waste gases at said upstream inlet section of said elongate conduit which is devoid of any combustion-supporting atmosphere, means for moving the mixture downstream to said combustion chamber section, ignitor means associated with the downstream end of the combustion chamber for providing a continuous supply of ignitor fuel gas to provide a flame within the combustion chamber in the presence of a combustion-supporting atmosphere, and oxygen inlet means immediately downstream of said combustion chamber for supplying a continuous source of an oxygen-containing gas to said ignitor means to support the ignition thereof and provide a flame within said combustion chamber to ignite the co-incineration gas and co-incinerate the waste gas within said combustion chamber to form safer incineration by-products at a location downstream of said inlet means in said upstream inlet section and upstream of said oxygen inlet means, and air inlet means associated with said downstream exhaust section for admitting a continuous supply of air for admixture with said incinerated by-products to cool said by-products and convey the mixture to an exhaust area of said exhaust section for release into the atmosphere.

9. An apparatus according to claim 8 in which said ignitor means comprises a tube means surrounding the inner periphery of said combustion chamber and provided with a plurality of ignitor fuel jet openings which extend inwardly towards the center of said combustion chamber to provide a ring of flames which induce co-incineration of the co-incineration fuel gas and the waste gases in a central area spaced from the walls of the combustion chamber.

10. An apparatus according to claim 8 in which said oxygen inlet means comprises an opening surrounding said conduit.

11. An apparatus according to claim 8 in which the exhaust area of said downstream exhaust section comprises temperature-sensing electrical means for sensing the temperature of said mixture at said area, electrical flow regulating means associated with the ignitor means for adjusting the supply of the ignitor fuel gas and waste gas producing equipment to regulate the size of the flame within the combustion chamber, and electrical control means associated with said temperature-sensing means to monitor the temperature of the combustion chamber and thereby control the temperature of the exhaust gases within a pre-set safe range for discharge into the atmosphere, or other gas treatment equipment.

12. An apparatus according to claim 8 in which said upstream inlet section terminates at said combustion chamber, and said downstream exhaust section has an upstream end which is co-axial with and spaced outwardly from said combustion chamber to provide an annular passage opening therebetween which comprises an air inlet means, surrounding said combustion chamber and opening into said conduit immediately downstream of said combustion chamber, for introducing a continuous supply of air to provide the combustion-supporting atmosphere within the combustion chamber, to mix with and cool the incineration by-products and to convey said by-products as an exhaust mixture downstream to said exhaust area.

13. An apparatus according to claim 12 in which said downstream exhaust section comprises an intermediate mixing area for creating a turbulence in said exhaust mixture to produce a more uniform and cooler exhaust mixture.

14. An apparatus according to claim 12 in which the exhaust area of said downstream exhaust section comprises means for sensing the temperature of said incineration by-products.

15. An apparatus according to claim 14 in which the temperature-sensing means comprises electrical means associated with electrical flow-regulating means for adjusting the ignitor fuel gas to the ignitor means and waste gas producing equipment to adjust the size of the flame and the temperature in the combustion chamber, an electrical control means associated with said temperature-sensing and said flow-regulating means for automatically adjusting the temperature of the combustion chamber and of the exhaust gases within a pre-set safe range for exhaust into the atmosphere, or other gas treatment equipment.

* * * * *